US005733010A

United States Patent [19]

Lewis et al.

[11] Patent Number: 5,733,010

[45] Date of Patent: Mar. 31, 1998

[54] RELEASABLE ARM FOR DENTAL PATIENT CHAIR

[76] Inventors: John W. Lewis, 2200 Willow Dr., Newberg, Oreg. 97132; Barry S. Young, 17440 SW. Cheyenne Way, Tualatin, Oreg. 97062

[21] Appl. No.: 140,252

[22] Filed: Oct. 21, 1993

[51] Int. Cl.[6] ..... A47C 7/54

[52] U.S. Cl. ..... 297/411.32; 297/411.38; 297/115

[58] Field of Search ..... 297/115, 411.3, 297/411.32, 411.34, 411.38

[56] References Cited

U.S. PATENT DOCUMENTS

| | | | |
|---|---|---|---|
| 3,116,093 | 12/1963 | Bosack | 297/115 X |
| 4,655,501 | 4/1987 | Ishigami et al. | 297/411.32 X |
| 4,807,935 | 2/1989 | King | 297/411.38 |
| 5,320,415 | 6/1994 | Krebs | 297/411.32 |

FOREIGN PATENT DOCUMENTS

| | | | |
|---|---|---|---|
| 2502727 | 8/1975 | Germany | 297/411.32 |
| 3128653 | 2/1983 | Germany | 297/411.32 |

*Primary Examiner*—Laurie K. Cranmer
*Attorney, Agent, or Firm*—Trask, Britt & Rossa

[57] ABSTRACT

A dental patient chair having support arms extending from a chair back above and alongside a chair seat and latch means operable by a user to release the support arm from a locked first use position or a locked second out-of-the-way position for movement between said positions.

9 Claims, 3 Drawing Sheets

RELEASABLE ARM FOR DENTAL PATIENT CHAIR

BACKGROUND OF THE INVENTION

1. Field

This invention relates to arms secured to a professional services chair. It is particularly directed to an arm that is movable between a first position providing support for the arms of a person seated in the chair and a second position moved out-of-the-way of a person entering or leaving the chair.

2. State of the Art

Chairs used by professional services providers conventionally include a seat, a chair back, and fixed arms. The arms of such chairs present a barrier to an individual attempting to assume or depart from a seated position on the chair. Accordingly, professional service chairs have been proposed that do not include arms. It is generally desirable, however, for many professional service chairs, notably dental patient chairs, to have side arms that can be grasped by a patient entering or moving out of the chair. It is also considered desirable to provide a support for the arm of an individual seated in the chair, whether in an upright or reclined position. While side arms are of concern to mechanical chairs used by the practitioners of various professions, they are of particular concern to dental practitioners.

The chairs used in other professional fields to provide medical, physical therapy or personal grooming services to a supine or seated patient or client have similar limitations and shortcomings. There thus remains a need for a professional chair with an improved arm structure; one that provides for good support in use and which can be repositioned to accommodate ingress and egress.

SUMMARY OF THE INVENTION

According to this invention, a chair, such as a reclining dental patient chair, is provided with support arms extending from adjacent its back above its seat. At least one of the arms is pivotable between a locked first use position, above and approximately parallel the seat, and a locked second, out-of-the-way position, transverse the seat and near the back. A latch is operable to release the pivoting arm from those first and second positions. Both arms of the chair may be similarly structured, but in some instances, one of the arms may be stationary.

A typical chair of this invention comprises a chair seat, a chair back positioned transverse the chair seat, a support arm positioned adjacent the chair back, means pivotally mounting the support arm with respect to the chair back to be pivotable between a first position extending from the chair back and alongside and above the chair seat, and a second position extending alongside the chair back but out-of-the-way of the seat, and means releasably locking the support arm in each of the first and second positions. It is within contemplation that additional selected positions of the arm may be provided for, but the invention is described for convenience with reference to these two primary positions.

One suitable means for pivotally mounting the support arm includes an armrest base carried by the arm and a pivot shaft structurally associated with the chair back and the arm rest. The arm may be releasably locked into the selected position by a mechanism which includes a first latching element fixed to the chair back, a second latching element fixed to the armrest base, structure associated with the first and second latching elements, operable to lock the arm in each of the first and second (or additional) positions, and latch release means operable to release the arm from locked condition. In released, or unlocked, condition, the arm is permitted to be pivoted between the various locked positions.

The first latching element may comprise a stop plate fixed to the chair back. The stop plate may be structured to include a guide channel, such as an arcuate groove, formed with appropriate registration recesses, such as bore holes, at spaced locations. In that event, the second latching element may comprise a detent projecting from the armrest base into the guide channel. The latching structure may then comprise means camming the detent into the guide channel. With the arm properly positioned in one of its locked positions, the detent registers with, and is thus cammed into, the corresponding recess. The latch release means is operable to permit the detent to be cammed out from the recess with which it is registered. A typical latch release includes a latch lever pivotally mounted to the armrest base so that a first end of the lever is positioned to be manipulated by an operator and a second end is connected to linkage for the detent.

The present invention is typically incorporated in a chair mounted upon a support extending up from a pedestal base. The chair is thus generally of a type used for the delivery of professional services, but is provided with an improved arm arrangement. The improved arm structure of this invention has broad utility, but is described in this disclosure with particular reference to a dental patient chair.

In the presently preferred dental patient chairs of this invention, arms are pivotally mounted to opposite sides of the chair back, and are cantilevered from the chair back to extend above the level of the chair seat in a use position. A latch lever extends rearwardly and downwardly from each arm to a handle that is readily actuated by a dentist or dental assistant to release the arm for pivoting to a non-interfering position. A latching mechanism locks the arm in its non-interfering position until the handle is engaged and the latch lever is thereby again actuated. The arm can then be manipulated by an operator, using the same hand used to operate the latch lever, to its use position.

BRIEF DESCRIPTION OF THE DRAWINGS

In the drawings, which illustrate what is currently regarded as the best mode for carrying out the invention.

DESCRIPTION OF THE ILLUSTRATED EMBODIMENT

Figure 1:
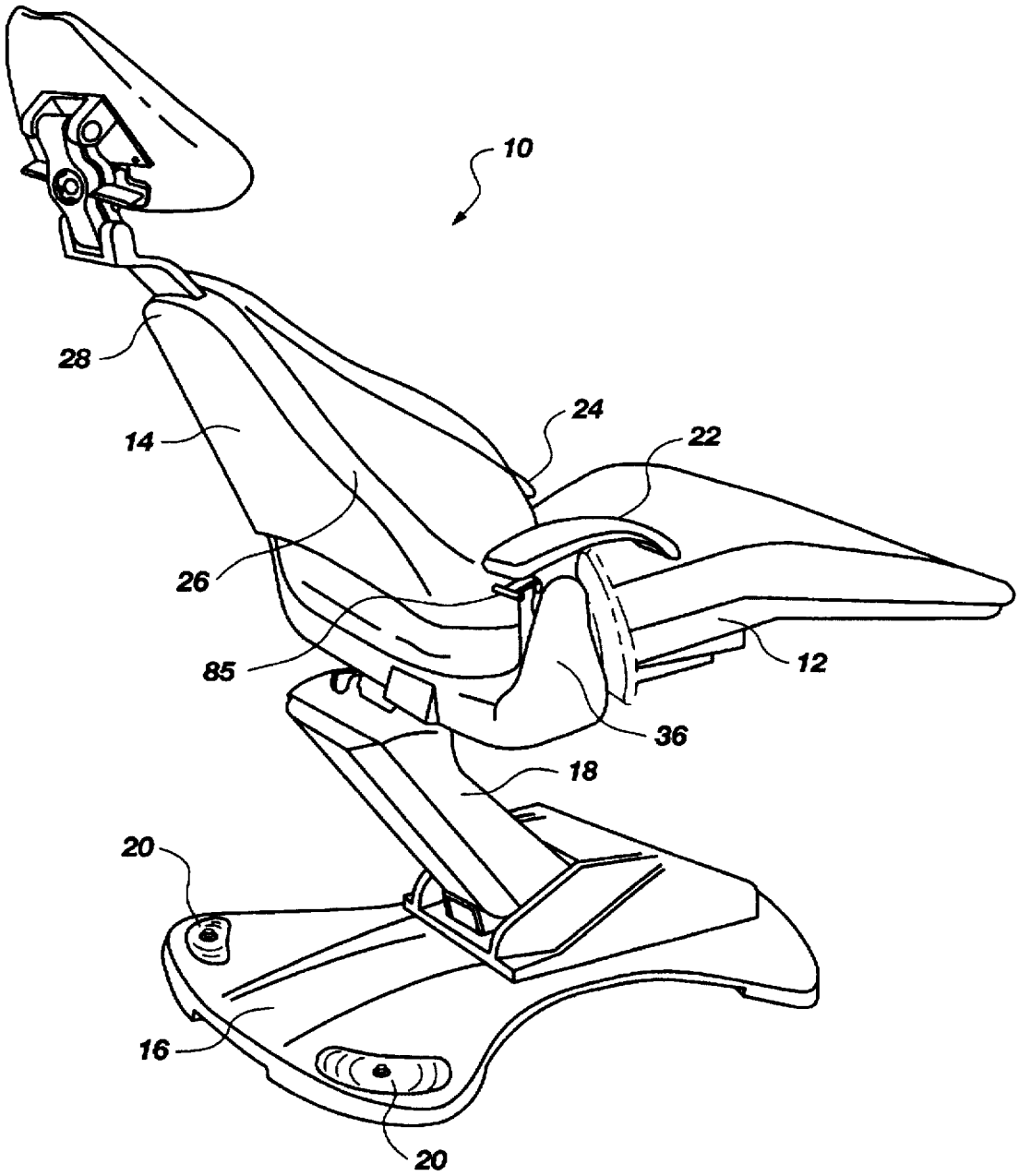
FIG. 1 is a perspective view of a dental patient chair having arms of the invention mounted to the chair back.

A dental patient chair embodying the invention is designated generally 10 in FIG. 1. The chair 10 includes a chair seat 12, and a chair back 14 that is pivotally mounted with respect to the chair seat. A base 16 pivotally supports a pedestal 18, which is in turn pivotally connected to the chair seat 12. Control switches 20 mounted in the base 16 function to control, among other things, drive mechanisms which pivot the chair back relative to the chair seat and which position the chair back and seat relative to the base 16.

Support arms 22 and 24 are respectively mounted to opposite sides 26 and 28 of the chair back 14. Each of the support arms 22 and 24 is mounted to assume the use position shown in solid lines, FIG. 1; specifically, extending from the chair back 14 above, alongside and approximately parallel the chair seat 12. In addition, each of the support arms is mounted to be pivotable from its use position to an out-of-the-way position, as shown by arm 22 in phantom lines, FIG. 1; transverse its use position and approximately adjacent a respective side of the back 14.

Figure 2:
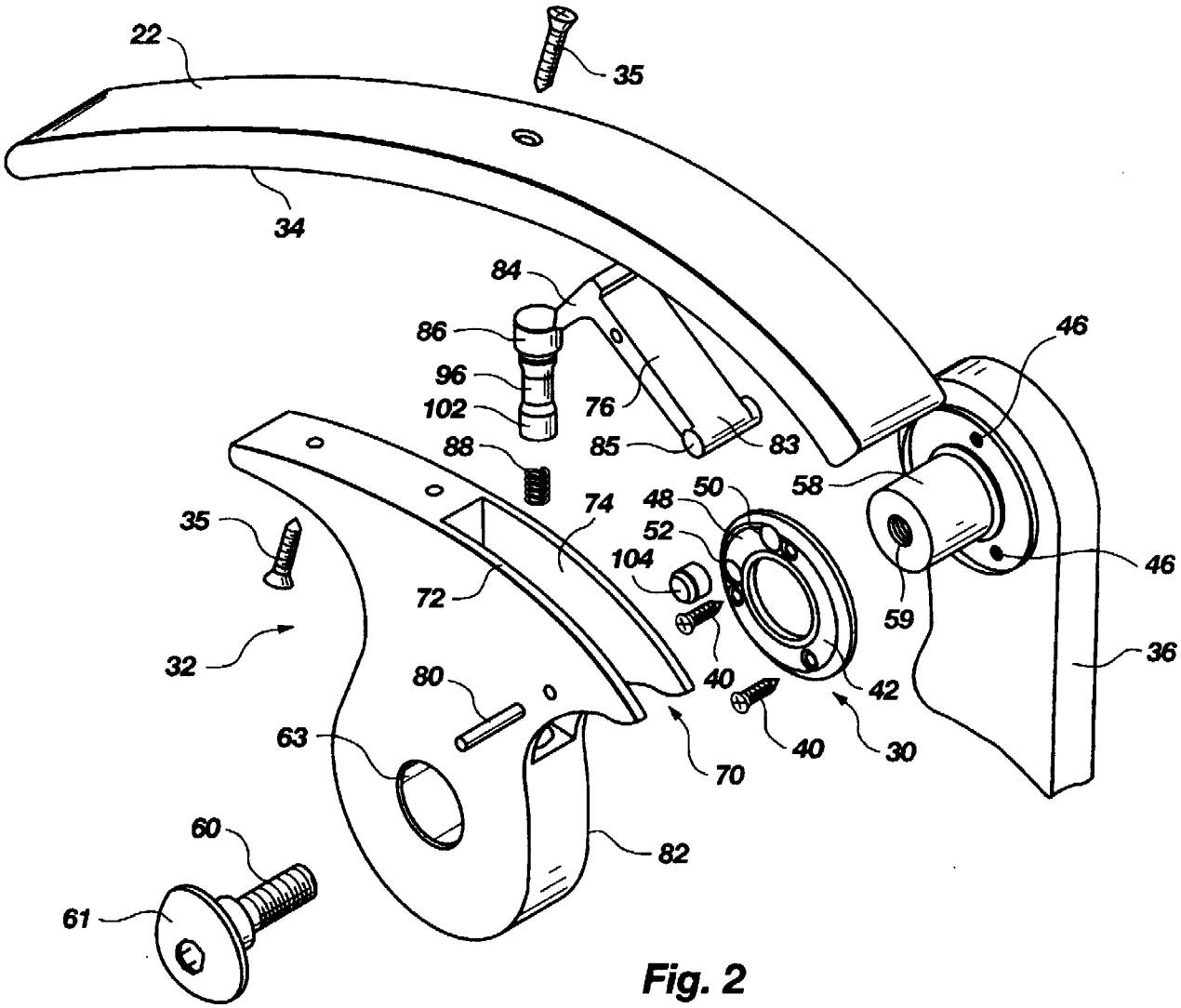
FIG. 2, is an enlarged exploded perspective view of an arm and latch assembly of the invention.
Figure 3:
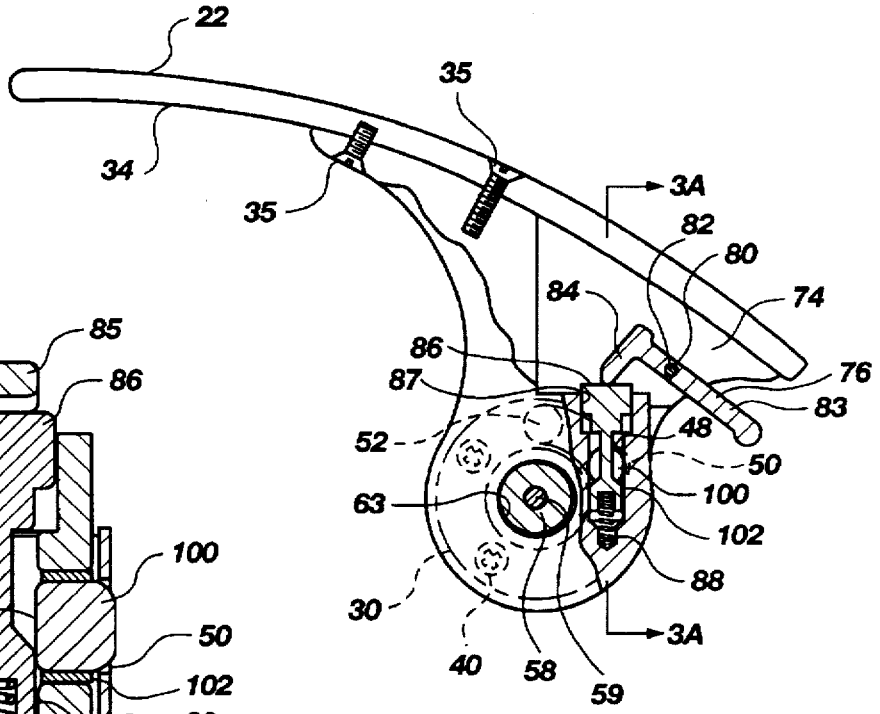
FIG. 3, is a side elevation view, partially broken away, of the components illustrated by FIG. 2, but in assembled condition.
Figure 3A:
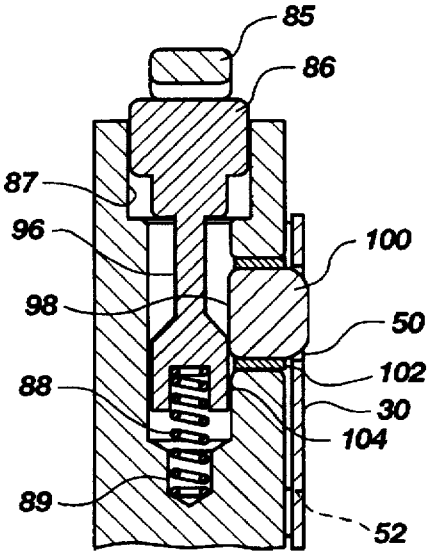
FIG. 3A is an enlarged vertical section, taken on the line 3A—3A of FIG. 3.
Figure 4A:
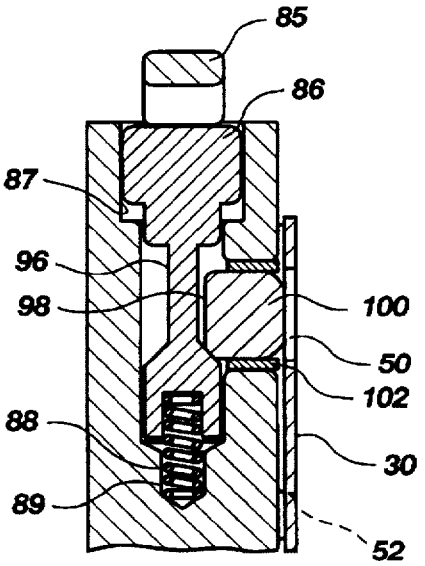
FIG. 4A is a view like that of FIG. 3A, but showing the components positioned as in FIG. 4.
Figure 4:
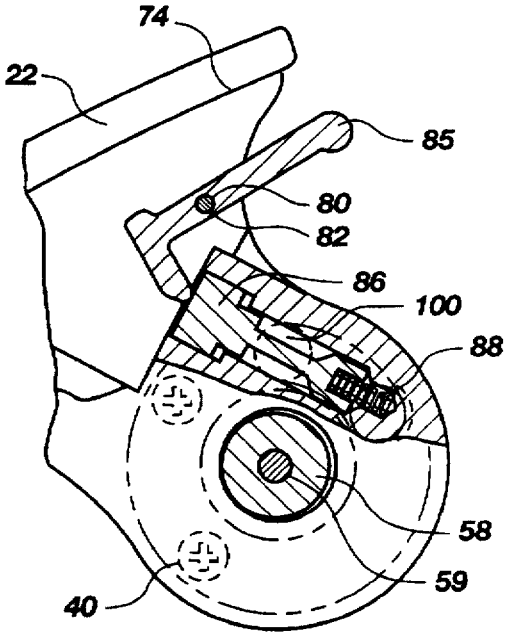
FIG. 4, is a fragmentary view like that of FIG. 3, but with certain components shown rotated.

As best shown by FIG. 2, a mounting mechanism for each of the arms 22 and 24 includes a circular armrest stop plate, designated generally 30, and an armrest base, designated generally 32. As illustrated, the armrest base 32 is fixed to an undersurface 34 of the curved support arm 22 by screws 35. A substantially identical arrangement is provided for the arm 24.

An arm support member 36 extends upwardly from the chair seat 12. The armrest stop plate 30 is attached to the arm support member 36 by screws 40, which are inserted through a face 42 of the plate 30 and are threaded into holes 46 in the arm support member 36. An arcuate groove 48 is formed in the outer edge of face 42, and bore holes 50 and 52 are respectively located at the respective opposite ends of the groove 48. As illustrated, the groove 48 extends across approximately ninety degrees of arc concentric with a shaft 58, which extends in cantilevered arrangement from the arm support 36.

The armrest base 32 is mounted to pivot on the shaft 58. A tapped hole 59 in the shaft 58 receives the threaded end 60 of a shoulder bolt 61. The bolt 61 thus holds the armrest base 32, and thus the arm 22, in mounted condition, with the shaft 58 journaled within the hole 63. Arm support member 36 is spaced from the side 26 of the chair back 12 to provide adequate clearance for the arm 22 to pivot.

Armrest base 32 is bifurcated at 70 to provide spaced apart structural sidewalls 72 and 74. A latch release 76 is pivotally mounted on a pin 80 through a bore 82 intermediate its length, the pin 80 also extending through the walls 72 and 74. One arm 83 of latch release 76 extends from the pivot pin 80 opposite an L-shaped working arm 84, and forms a release lever with a transversely extending handle 85 that, when raised and pivoted about pin 80, forces a stem 86 downward through a guide bore 87. A spring 88 in a counterbore 89 at the bottom of guide bore 87 acts to bias the stem 86 out of the bore. Thus, when the latch lever 83 is released, the stem 86 is raised by the spring 88.

Stem 86 includes a relieved portion formed as a notch 96. When the stem is lowered by movement of latch lever 76, notch 96 is positioned to allow a blunt nose 98 of a bullet-shaped detent 100 to be cammed further into armrest base 32. Detent 100 passes through a bushing 102. Engagement of the edge of hole 50 or hole 52 with the detent 100 urges the detent out of the hole and into the groove 48. When the stem 86 is raised upon release of the latch lever 83, and by action of the spring 88, an edge 104 of the notch 96 cams the detent 100 to project from the armrest base 32, through the wall 74 and into one of the holes 50 or 52 of the stop plate 30. The stem 86 positively locks the detent 100 into a hole 50 or 52, except when the notch 96 receives the detent 100. When the notch 96 is positioned to receive the detent 100, the detent 100 is captured within groove 48.

When the support arm 22 (or 24) is positioned in either the use position or the out-of-the-way position and latch release lever 76 is released, stem 86 is biased upwardly and the detent 100 is cammed into registration with either bore hole 50 or bore hole 52. This registration locks the support arm in position and against undesired movement. Locked in the out-of-the-way position, the arm will not move even if a person entering or exiting the chair should use the arm for support.

The latch release levers 76 extend rearwardly with respect to the arms 22 and 24, thereby to position the handle 85 for ready access by a dentist or dental assistant positioned behind the chair 10.

While the invention has been described with particular reference to details of the illustrated embodiment, the appended claims are intended to encompass equivalent structures, without regard to the particular environment of use appropriate for various other specific embodiments.

What is claimed is:

1. A chair, comprising:

a chair seat;

a chair back positioned transverse said chair seat;

a support arm positioned adjacent said chair back;

first structural means pivotally mounting said support arm with respect to said chair back to be pivotable between a first position extending from said chair back alongside and above said chair seat and a second position extending alongside said chair back and out of the way of said seat, said first structural means including:

an armrest base carried by said support arm, and a pivot shaft structurally associated with said chair back; and second structural means releasably locking said support arm in each of said first and second positions, said second structural means including:

a first latching element fixed to an arm support member structurally associated with said chair back, a second latching element fixed to said armrest base, latching structure associated with said first and second latching elements, operable to lock said support arm in each of said first and second positions, and latch release means operable to release said support arm from locked condition, whereby to permit said support arm to be pivoted between said first and second positions, said latch release means including a latch lever; and means pivotally mounting said latch lever to said armrest base with a first end of said lever extending, in both said first and second positions, to the rear of said armrest base to be manipulated by an operator and a second end operated against actuation means for said first and second latching elements.

2. A chair, comprising:

a chair seat;

a chair back positioned transverse said chair seat;

a support arm positioned adjacent said chair back;

first structural means pivotally mounting said support arm with respect to said chair back to be pivotable between a first position extending from said chair back alongside and above said chair seat and a second position extending alongside said chair back and out of the way of said seat, said first structural means including:

an armrest base carried by with said support arm, and a pivot shaft structurally associated with said chair back; and second structural means releasably locking said support arm in each of said first and second positions, said second structural means including:

a first latching element fixed to an arm support member structurally associated with said chair back, a second latching element fixed to said armrest base, latching structure associated with said first and second latching elements, operable to lock said support arm in each of said first and second positions, and latch release means operable to release said support arm from locked condition, whereby to permit said support arm to be pivoted between said first and second positions, said latch release means including a latch lever; and means pivotally mounting said latch lever to said armrest base with a first end of said lever extending to the rear of said armrest base to be manipulated by an operator and a second end operated against actuation means for said first and second latching elements; wherein:

said first latching element comprises a stop plate fixed to an arm support member carrying said pivot shaft, said stop plate having a guide channel formed therein with registration recesses at spaced locations within said channel;

said second latching element comprises a detent projecting from said armrest base into said channel;

said latching structure comprises means camming said detent into said channel and said recesses; and said latch release means is operable to permit said detent to be cammed out from said recesses.

3. A chair according to claim 2, wherein:

said guide channel is an arcuate groove, and registration recesses are located at opposite ends of said channel.

4. A chair according to claim 3 wherein said registration recesses are bore holes.

5. A chair, comprising:

a chair seat;

a chair back positioned transverse said chair seat;

a support arm positioned adjacent said chair back;

first structural means pivotally mounting said support arm with respect to said chair back to be pivotable between a first position extending from said chair back alongside and above said chair seat and a second position extending alongside said chair back and out of the way of said seat, said first structural means including:

an armrest base carried by said support arm, and a pivot shaft structurally associated with said chair back; and second structural means releasably locking said support arm in each of said first and second positions, said second structural means including:

a first latching element fixed to said support arm, said first latching element comprising a stop plate fixed to an arm support member carrying said pivot shaft, said stop plate having a guide channel formed therein with registration recesses at spaced locations within said channel;

a second latching element fixed to said armrest base, said second latching element comprising a detent projecting from said armrest base into said channel;

latching structure associated with said first and second latching elements, operable to lock said support arm in each of said first and second positions, wherein said latching structure comprises means camming said detent into said channel and said recesses; and latch release means operable to release said support arm from locked condition, whereby to permit said support arm to be pivoted between said first and second positions, said latch release means including:

a latch lever;

means pivotally mounting said latch lever to said armrest base with a first end of said lever extending to the rear of said armrest base to be manipulated by an operator and a second end operated against actuation means for said first and second latching elements whereby said latch release means is operable to permit said detent to be cammed out from said recesses; and said actuation means for said detent includes:

a stem reciprocally mounted in said armrest base, said stem including a notch structured and arranged to receive said detent; and said detent being biased against said stem and positioned to register with said notch when the stem is moved to a selected position.

6. A chair according to claim 5, wherein:

a portion of said armrest base is bifurcated to form a pair of spaced apart walls, and said detent is mounted to reciprocate through one of said walls.

7. A chair according to claim 4, wherein:

said detent has a bullet-shaped end extending into said channel, whereby said detent registers with a said recess when said armrest is in either of said first or second positions and is cammed from said recess upon pivoting of said latch lever and movement of said armrest away from either of said first or second positions.

8. A chair, comprising:

a chair seat;

a chair arm positioned transverse said chair seat;

a support arm positioned adjacent said chair back;

first structural means pivotally mounting said support arm with respect to said chair back to be pivotable between a first position extending from said chair back alongside and above said chair seat and a second position extending alongside said chair back and out of the way of said seat, said first structural means including:

an armrest base carried by said support arm, and a pivot shaft structurally associated with said chair back; and second structural means releasably locking said support arm in each of said first and second positions said second structural means including a first latching element fixed to said support arm, said first latching element comprising a stop plate fixed to an arm support member carrying said pivot shaft, said stop plate having a guide channel structured as an arcuate groove formed therein with registration recesses at spaced locations within said channel, including registration recesses located at opposite ends of said channel;

a second latching element fixed to said armrest base, said second latching element comprising a detent projecting from said armrest base into said channel;

latching structure associated with said first and second latching elements, operable to lock said support arm in each of said first and second positions, wherein said latching structure comprises means camming said detent into said channel and said recesses; and latch release means operable to release said support arm from locked condition, whereby to permit said support arm to be pivoted between said first and second positions, said latch release means including:

a latch lever;

means pivotally mounting said latch lever to said armrest base with a first end of said lever extending to the rear of said armrest base to be manipulated by an operator and a second end operated against acturation means for said first and second latching elements whereby said latch release means is operable to permit said detent to be canned out from said recesses; and a portion of said armrest base being bifurcated to form a pair of spaced apart structural walls, and said detent is mounted to reciprocate through one of said walls.

9. A chair according to claim 8, wherein:

said detent has a bullet-shaped end extending into said channel, whereby said detent registers with a said bore hole when said armrest is in either of said first or second positions and is cammed from said bore hole upon pivoting of said latch lever and movement of said armrest away from either of said first or second positions.

* * * * *

UNITED STATES PATENT AND TRADEMARK OFFICE

CERTIFICATE OF CORRECTION

PATENT NO. : 5,733,010
DATED : March 31, 1998
INVENTOR(S) : Lewis et al.

It is certified that error appears in the above-identified patent and that said Letters Patent is hereby corrected as shown below:

In column 6, line 25, change "claim 4" to --claim 6--;

In column 6, line 36, change "arm" to --back--;

In column 7, line 8, change "acturation" to --actuation--;

In column 7, line 11, change "canned" to --cammed--

Signed and Sealed this

Seventeenth Day of October, 2000

*Attest:*

Q. TODD DICKINSON

*Attesting Officer*

*Director of Patents and Trademarks*